US005101887A

United States Patent [19]

Kado

[11] Patent Number: 5,101,887

[45] Date of Patent: Apr. 7, 1992

[54] HEAT EXCHANGER

[75] Inventor: Hirotaka Kado, Isesaki, Japan

[73] Assignee: Sanden Corporation, Gunma, Japan

[21] Appl. No.: 658,329

[22] Filed: Feb. 20, 1991

[30] Foreign Application Priority Data

Feb. 22, 1990 [JP] Japan ..... 2-17168[U]

[51] Int. Cl.[5] ..... F28F 9/04

[52] U.S. Cl. ..... 165/76; 165/173; 228/136; 228/183

[58] Field of Search ..... 165/76, 152, 153, 173; 228/136, 183, 212

[56] References Cited

U.S. PATENT DOCUMENTS

| | | | |
|---|---|---|---|
| 1,438,596 | 12/1922 | Harding | 165/173 X |
| 2,752,129 | 6/1956 | Modine . | |
| 2,788,232 | 4/1957 | Stadthaus . | |
| 3,238,606 | 3/1966 | Tolson . | |
| 3,307,622 | 3/1967 | Oddy . | |
| 3,589,440 | 6/1971 | Friedrich . | |
| 3,689,972 | 9/1972 | Mosier et al. . | |
| 3,708,012 | 1/1973 | Zimprich | 165/152 |
| 3,866,675 | 2/1975 | Bardon et al. | 165/173 |
| 3,920,069 | 11/1975 | Mosier | 165/150 |
| 3,993,126 | 11/1976 | Taylor . | |
| 4,026,456 | 5/1977 | Lema | 228/136 |
| 4,157,153 | 6/1979 | Barnes | 228/136 |
| 4,513,811 | 4/1985 | Lesniak | 165/79 |
| 4,529,034 | 7/1985 | Saperstein . | |
| 4,615,385 | 10/1986 | Saperstein et al. . | |
| 4,620,590 | 11/1986 | Koisuka et al. . | |
| 4,678,112 | 7/1987 | Koisuka et al. . | |
| 4,730,669 | 3/1988 | Beasley et al. . | |
| 4,825,941 | 5/1989 | Hoshino et al. | 165/110 |
| 4,957,158 | 9/1990 | Ando . | |

FOREIGN PATENT DOCUMENTS

| | | |
|---|---|---|
| 52-35736 | 3/1977 | Japan . |
| 58-167039 | 10/1983 | Japan . |
| 59-225900 | 12/1984 | Japan . |
| 61-144266 | 7/1986 | Japan . |
| 61-235698 | 10/1986 | Japan . |

*Primary Examiner*—Allen J. Flanigan
*Attorney, Agent, or Firm*—Banner, Birch, McKie & Beckett

[57] ABSTRACT

The heat exchanger comprises a plurality of oval-shaped flat tubes for conducting refrigerant and a plurality of corrugated fins fixedly sandwiched between the flat tubes. First and second header pipes are fixedly and hermetically connected tot he flat tubes through openings formed on the header pipes and communicate with the interior of the flat tubes. The flat tubes include a pair of wedge-shaped projections at the opposite ends thereof, respectively. At least one pair of wedge-shaped projections engage with an interior surface of the header pipes adjacent to the openings when the flat tubes are received into the interior of the header pipes through the openings, thereby preventing relative sliding motion between the header pipes and the flat tubes through the openings. The wedge-shaped projection may be disposed on either the upper and lower flat surfaces or the curved side surfaces of the flat tubes.

25 Claims, 8 Drawing Sheets

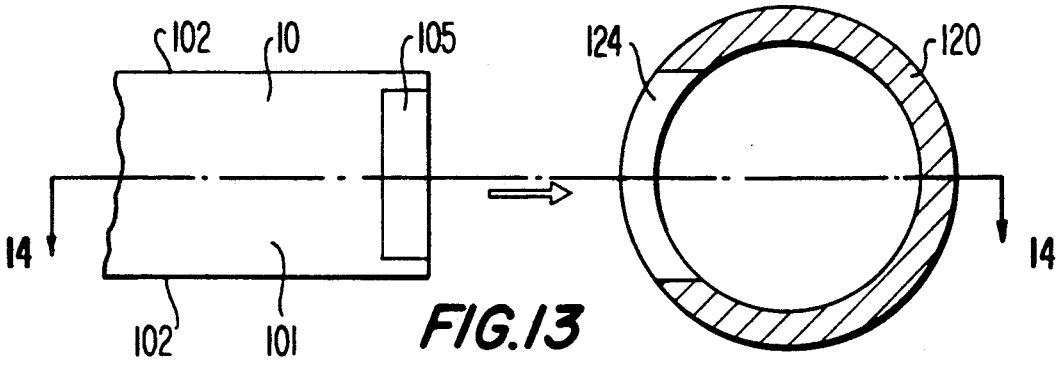
FIG. 13
FIG. 14
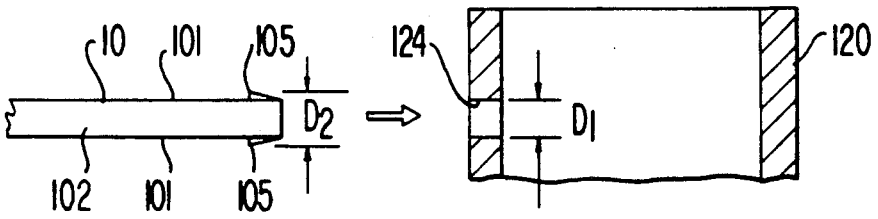
FIG. 15
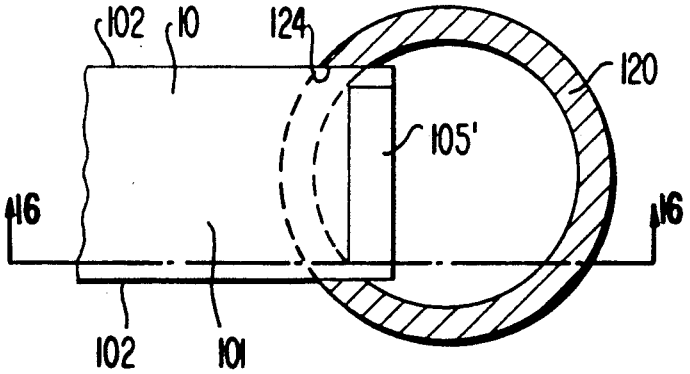
FIG. 16
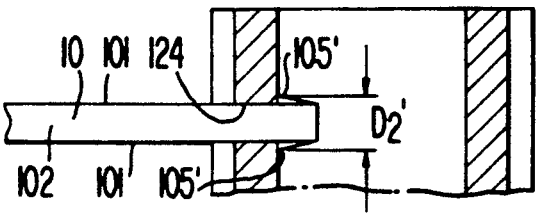

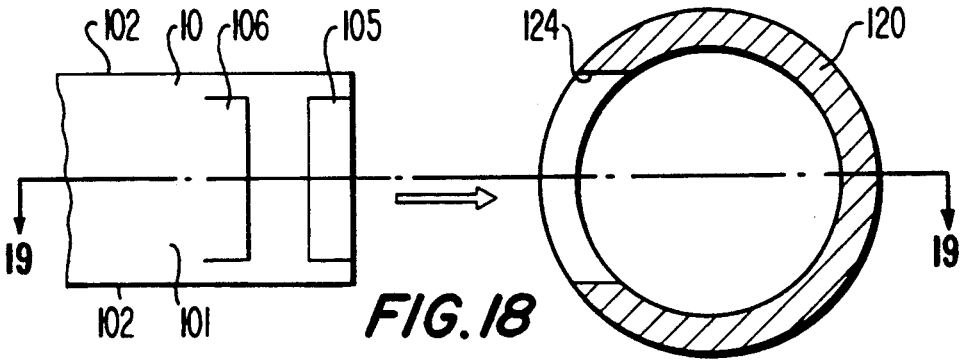
FIG. 18
FIG. 19
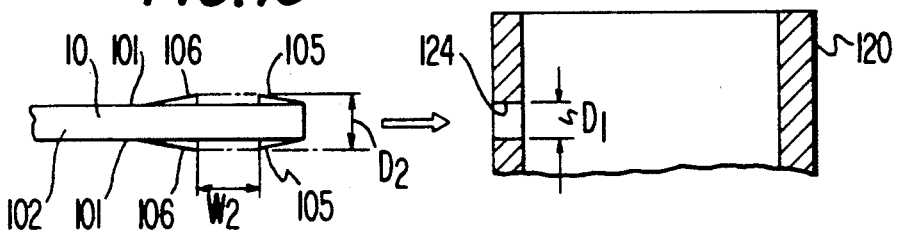
FIG. 20
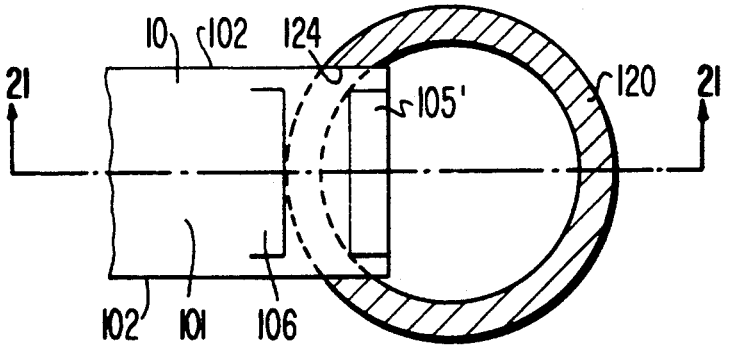
FIG. 21
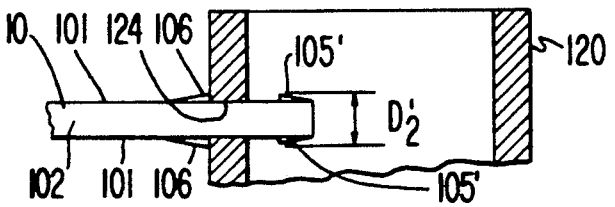

HEAT EXCHANGER

BACKGROUND OF THE INVENTION

1. Field of the Invention

The present invention relates to a heat exchanger, such as a condenser for use in an automotive air conditioning system.

2. Description of the Prior Art

Japanese Utility Model Application publication No. 63-142,586 discloses a heat exchanger, such as a condenser for use in an automotive air conditioning system as illustrated in FIGS. 1 and 2.

The condenser includes a plurality of adjacent, essentially flat tubes 10 each having a flat oval cross-section and a pair of open ends which allow refrigerant fluid to flow therethrough. Each flat tube 10 includes upper and lower flat surfaces 101 which are disposed in planes parallel to the direction of air flow as indicated by arrow "A", and opposite curved surfaces 102. One of opposite curved surfaces 102 connects one end of upper flat surface 101 with one end of the lower flat surface 101 and the other of opposite curved surfaces 102 connects the other end of upper flat surface 101 with the other end of lower flat surface 101. A plurality of corrugated fin units 12 are disposed between adjacent flat tubes 10. Each flat tube 10 includes a plurality of vertical partition walls 11 which are integrally formed on an inner surface of each flat tube 10. Vertical partition walls 11 are formed along the longitudinal axis of flat tubes 10 and divide the interior of flat tubes 10 into a plurality of longitudinally extending chambers. Corrugated fin units 12 are brazed to flat tubes 10 to form heat exchange region 100 as discussed below.

A pair of cylindrical header pipes 120 and 140 each having opposite open ends are disposed perpendicular to flat tubes 10 and may have, for example, a clad construction. The opposite open ends of header pipes 120 and 140 are fixedly and hermetically plugged by respective caps 121, 122, 141, and 142 by brazing. Plate 110, having a generally U-shaped cross-section, is fixedly disposed on an upper end of heat exchange region 100. The ends of plate 110 are fixedly connected to an inside region of an outer peripheral surface of the upper-most portion of header pipes 120 and 140 by brazing. Plate 111, also having a generally U-shaped cross-section, is fixedly disposed on a lower end of heat exchange region 100. The ends of plate 111 are fixedly connected to the inside region of an outer peripheral surface of the lowermost portion of header pipes 120 and 140 in the same manner as plate 110. Plates 110 and 111 reinforce the structural strength of the condenser.

Opening 123, having a diameter slightly greater than the outer diameter of inlet pipe 22, is formed at an upper portion of header pipe 120. After the termination of the brazing process, one end of cylindrical inlet pipe 22 is inserted into opening 123 and is then fixedly and hermetically connected thereto, for example, by a further brazing process. Inlet pipe 22 is provided with a conventional union joint (not shown) at the other end thereof.

An opening (not shown), having a diameter slightly greater than the outer diameter of outlet pipe 23, is formed at a lower portion of header pipe 140. One end of cylindrical outlet pipe 23 is inserted into the opening and is then fixedly and hermetically connected thereto in the same manner as inlet pipe 22. Inlet pipe 22 and outlet pipe 23 protrude from header pipes 120 and 140, respectively, in opposite directions. Inlet pipe 22 and outlet pipe 23 protrude in a plane perpendicular to the flow of air through heat exchange region 100.

Referring to FIGS. 3–5, a plurality of slots 124 having oval cross-sections are formed at equal intervals on an inner side of each of header pipes 120 and 140. The sizes of slots 124 is slightly greater than the outer sizes of flat tubes 10. The condenser is temporarily assembled by inserting the opposite longitudinal ends of each of flat tubes 10 into the interior of header pipes 120 and 140 through slots 124. The penetration of the longitudinal ends of flat tubes 10 terminates at approximately one-third of the diameter of an inner periphery of the header pipes as illustrated in FIG. 5. The flat tubes, the fin units, the header pipes, the caps, and the plates are all temporarily assembled with one another at the same time.

After the assembling process of the condenser is completed, the temporarily assembled condenser is transported from an assembly line to a furnace in which a brazing process is carried out. As a result of this transportation of the temporarily assembled condenser, the flat tubes 10 slide undesirably relative to header pipes 120 and 140 through slots 124. Therefore, when the brazing process of the condenser is completed, defects in the condenser may have occurred. The longitudinal ends of flat tubes 10 may have been disengaged from slots 124 or the brazed condenser may have a non-standard configuration because of the relative sliding of flat tubes 10.

In order to prevent the undesirable relative sliding motion between the flat tubes and the header pipes through the slots, it is known to use a fastening tool which is temporarily attached to the temporarily assembled condenser so as to firmly fasten the flat tubes and the header pipes to each other. The fastening tool is detached from the condenser after completion of the brazing process. However, the steps of attaching the fastening tool to the temporarily assembled condenser and detaching the fastening tool from the brazed condenser after completion of the brazing process complicates the manufacturing process of the condenser. Hence, the efficiency of manufacturing the condenser is decreased. Furthermore, the provision of the fastening tool increases the manufacturing costs of the condenser.

SUMMARY OF THE INVENTION

Accordingly, it is an objective of the present invention to provide a simply manufactured heat exchanger having a proper configuration and completely hermetic connections between a plurality of tubes and header pipes.

It is a further objective of this invention to provide a heat exchanger which can be temporarily assembled and transported without any relative sliding motion between the plurality of tubes and the header pipes.

It is a still further objective of the present invention to provide a heat exchanger which can be temporarily assembled to prevent the relative sliding between the plurality of tubes and the header pipes without decreasing the efficiency of manufacturing the invention and without significantly increasing manufacturing costs.

A heat exchanger in accordance with the present invention includes a plurality of tubes having opposite first and second open ends, a plurality of fin units disposed between the tubes, and first and second header pipes each having opposite closed ends. The header pipes include openings which receive the opposite ends of the tubes into the interior of the header pipes. The header pipes are fixedly and hermetically coupled to the opposite ends of the tubes to allow the tubes to communicate with the interior of the header pipes. At least one of the opposite ends of the tubes includes a projection extending outwardly from an exterior surface thereof. The projection engages with an interior surface of the header pipe adjacent to the opening when the opposite ends of the tubes are received into the interior of the header pipes through the openings.

BRIEF DESCRIPTION OF THE DRAWINGS

FIG. 13 illustrates a partial horizontal sectional view of the condenser shown in FIG. 12.

FIG. 14 illustrates a cross-sectional view taken along line 14—14 of FIG. 13.

FIG. 15 illustrates a view similar to FIG. 13, more specifically, a view when the condenser is temporarily assembled.

FIG. 16 illustrates a cross-sectional view taken along line 16—16 of FIG. 15.

FIG. 18 illustrates a partial horizontal sectional view of the condenser shown in FIG. 17.

FIG. 19 illustrates a cross-sectional view taken along line 19—19 of FIG. 18.

FIG. 20 illustrates a view similar to FIG. 18, more specifically, a view when the condenser is temporarily assembled.

FIG. 21 illustrates a cross-sectional view taken along line 21—21 of FIG. 20.

DETAILED DESCRIPTION OF THE PREFERRED EMBODIMENTS

Figure 1:
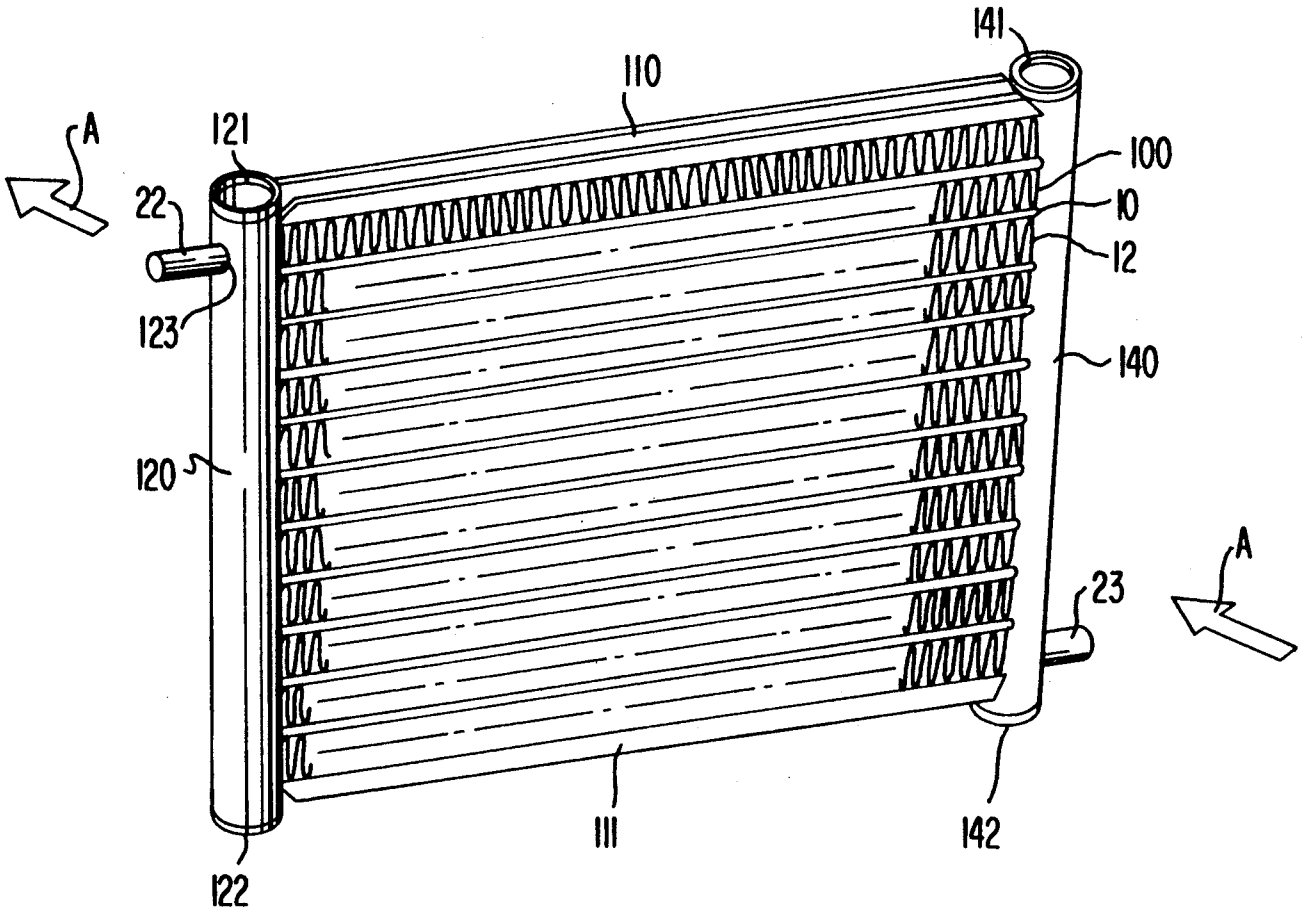
FIG. 1 (PRIOR ART)
FIG. 1 illustrates a perspective view of a condenser in accordance with one embodiment of the prior art.
Figure 2:
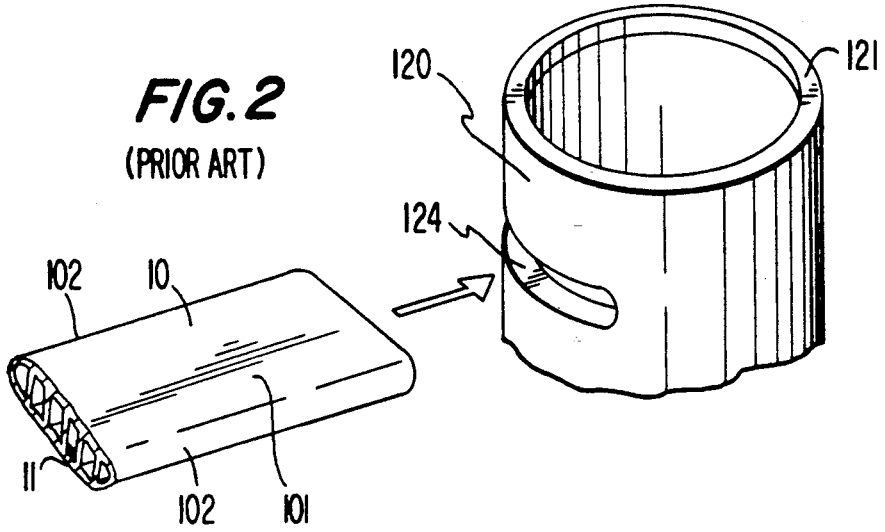
FIG. 2 (PRIOR ART)
FIG. 2 illustrates an exploded partial perspective view of the condenser shown in FIG. 1.
Figure 3:
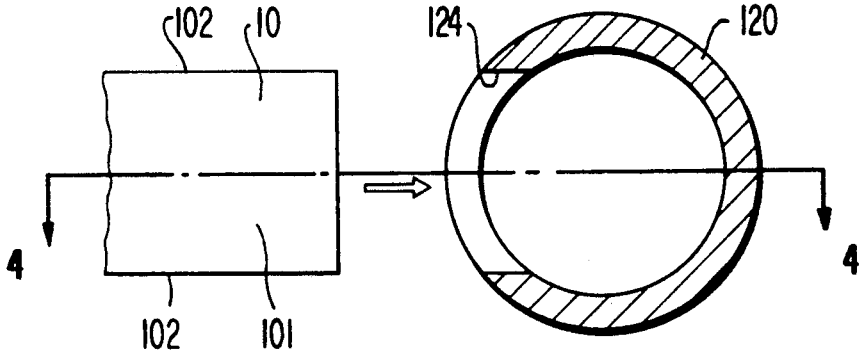
FIG. 3 (PRIOR ART)
FIG. 3 illustrates a partial horizontal sectional view of the condenser shown in FIG. 1.
Figure 4:
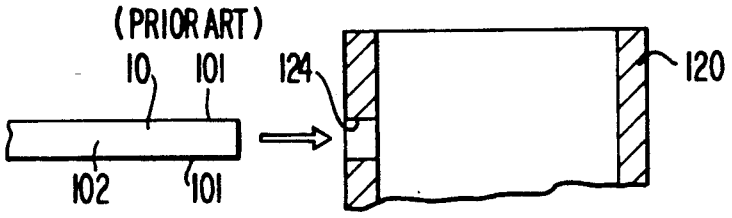
FIG. 4 (PRIOR ART)
FIG. 4 illustrates a cross-sectional view taken along line 4—4 of FIG. 3.
Figure 5:
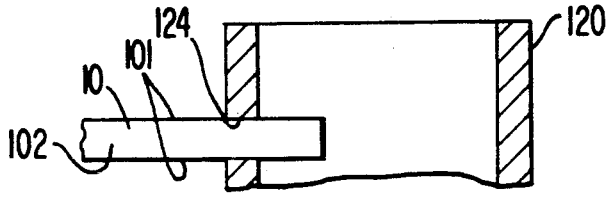
FIG. 5 (PRIOR ART)
FIG. 5 illustrates a view similar to FIG. 4, more specifically, a view when the condenser is temporarily assembled.

A first embodiment through a fifth embodiment of the present invention are illustrated in FIGS. 6–8, FIGS. 9–11, FIGS. 12–16, FIGS. 17–21, and FIGS. 22 and 23, respectively. The overall shape of the condenser is similar to that shown in FIG. 1, so a separate drawing is omitted.

In the drawings, the same numerals are used to denote the corresponding elements illustrated in FIGS. 1–5 so that an explanation thereof is omitted. Furthermore, the manner of connecting one longitudinal end of each flat tube 10 to header pipe 120 is identical to the manner of connecting the other longitudinal end of each flat tube 10 to header pipe 140. Therefore, hereinafter, only the manner of connecting one longitudinal end of each flat tube 10 to header pipe 120 is representatively described. Finally, the advantages obtained by the first embodiment are substantially similar to the advantages obtained by the other embodiments so that an explanation thereof is omitted.

Figure 6:
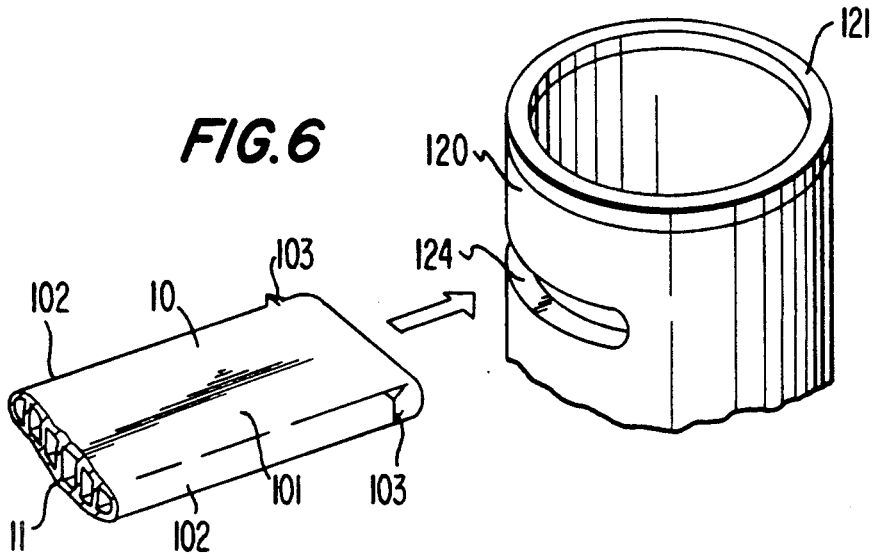
FIG. 6 illustrates an exploded partial perspective view of a condenser in accordance with a first embodiment of the present invention.
Figure 7:
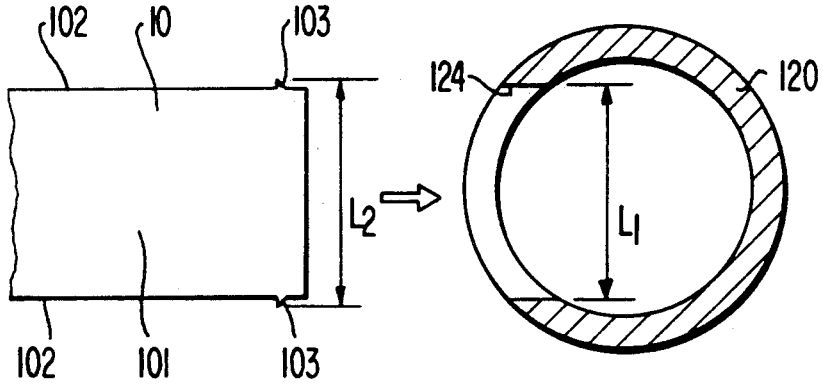
FIG. 7 illustrates a partial horizontal sectional view of the condenser shown in FIG. 6.
Figure 8:
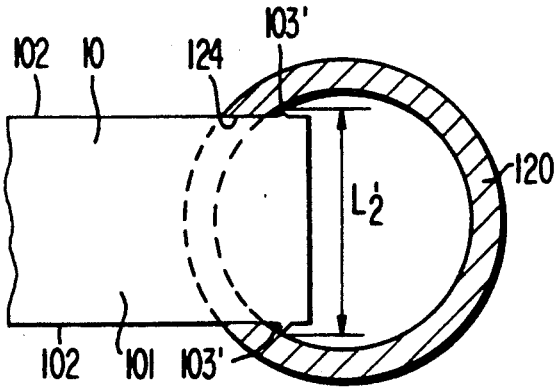
FIG. 8 illustrates a view similar to FIG. 7, more specifically, a view when the condenser is temporarily assembled.

Referring to FIGS. 6–8, a condenser in accordance with a first embodiment of the present invention includes a plurality of flat tubes 10 of aluminum alloy having a flat oval cross-section. A pair of identical wedge-shaped projections 103 are integrally formed on opposite curved surfaces 102 adjacent to each longitudinal end of each flat tube 10. One of wedge-shaped projections 103 is formed on one of the opposite curved surfaces 102 and the other of wedge-shaped projections 103 is formed on the other of opposite curved surfaces 102. Wedge-shaped projections 103 slant outwardly away from the longitudinal ends of each flat tube 10, and define ridges which extend laterally along curved surfaces 102 from locations adjacent upper and lower surfaces 101. Wedge-shaped projections 103 are formed by deforming flat tubes 10 after flat tubes 10 have been formed.

Referring to FIG. 7, a length "$L_2$", measured between the outer edges of the ridges of each wedge-shaped projection 103 of a pair, is designed to be slightly greater than a length "$L_1$" of each slot 124. The condenser is temporarily assembled by forcibly inserting one longitudinal end of each flat tube 10 into an interior of header pipe 120 through each slot 124. The insertion is terminated when the longitudinal end reaches a distance which is approximately one-third of the diameter of an inner periphery of header pipe 120 as illustrated in FIG. 8. Of course, the opposite other end of each flat tube 10 contains wedged-shaped portions 103 and is inserted into header pipe 140.

When the longitudinal end of each flat tube 10 is forcibly inserted into the interior of header pipe 120 through each slot 124, the pair of wedge-shaped portions 103 are deformed and compressed so as to be able to slidably pass through slot 124. However, after passing through slot 124, wedge-shaped portions 103 are generally restored to become a pair of wedge-shaped portions 103' by virtue of the elasticity of metal. Distance "$L_2$" between the outer edges of the ridges of each wedge-shaped portion 103' in a pair is still greater than length "$L_1$" of each slot 124. Hence, the undesirable relative sliding motion between flat tubes 10 and header pipe 120 through slots 124, and more particularly, the possibility of flat tubes 10 sliding out of slots 124 during the transportation of the temporarily assembled condenser is effectively prevented by wedge-shaped projections 103'. In addition, since the opposite ends of flat tubes 10 also contain wedges 103', they are precluded from sliding out of slots 124 as well. Thus, the possibility of flat tubes 10 sliding in either direction relative to head pipes 120 and 140 is substantially reduced. Accordingly, when the brazing process of the condenser is completed, the possibility that the longitudinal ends of flat tube 10 will have been disengaged from slots 124 is effectively eliminated, and the possibility of the brazed condenser having a nonstandard configuration is substantially reduced.

Figure 9:
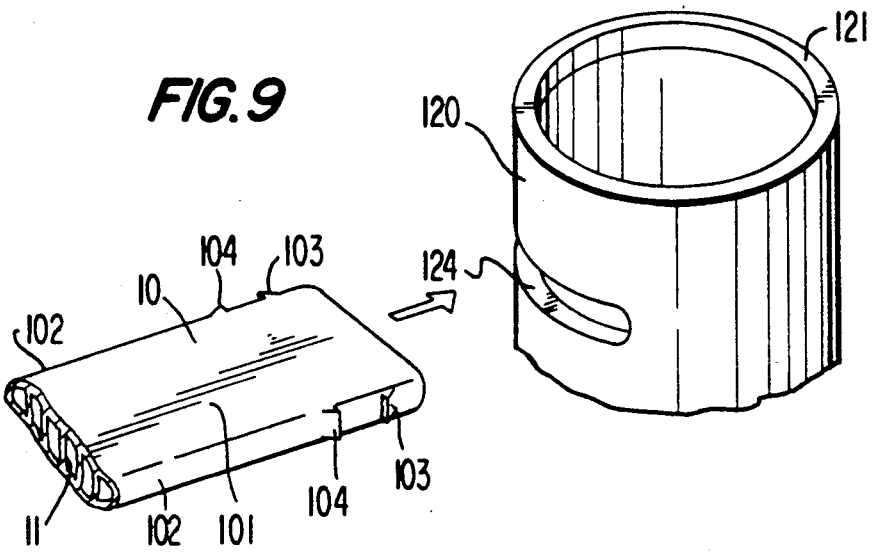
FIG. 9 illustrates an exploded partial perspective view of a condenser in accordance with a second embodiment of the present invention.
Figure 10:
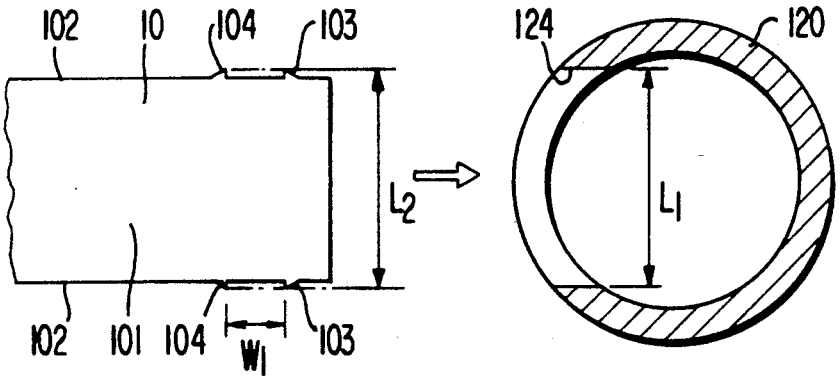
FIG. 10 illustrates a partial horizontal sectional view of the condenser shown in FIG. 9.
Figure 11:
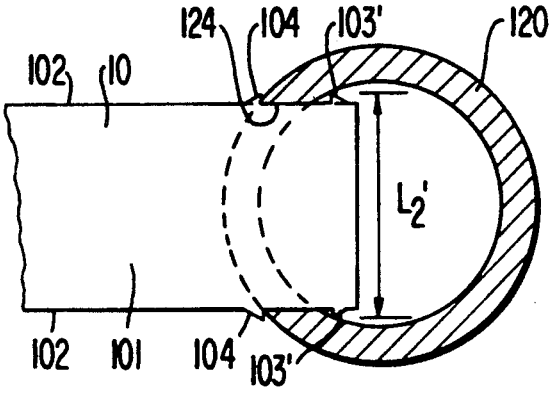
FIG. 11 illustrates a view similar to FIG. 10, more specifically, a view when the condenser is temporarily assembled.
Figure 17:
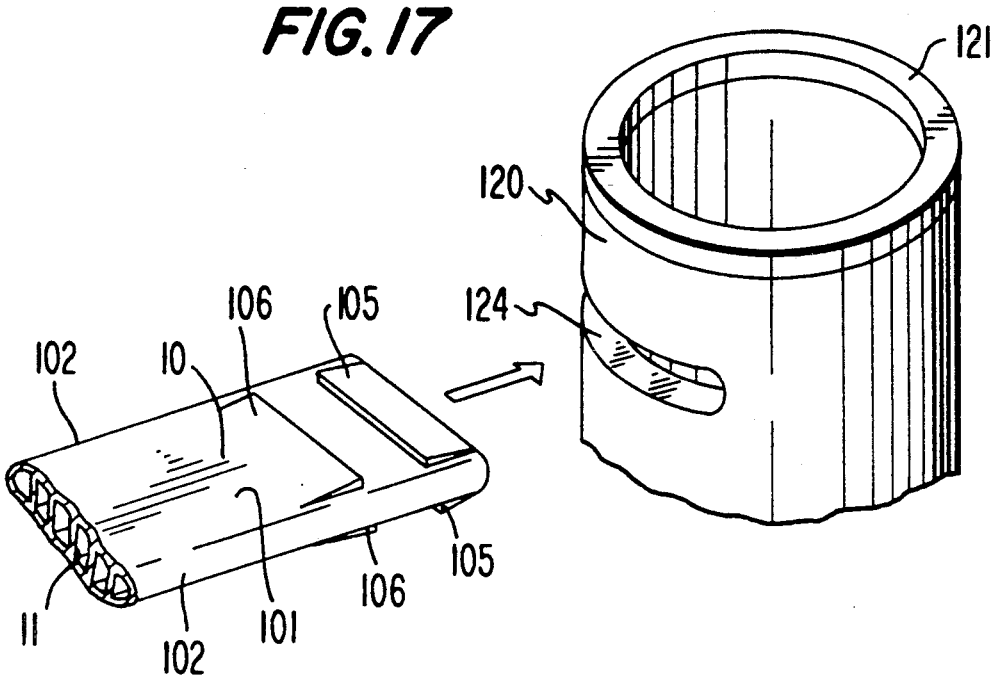
FIG. 17 illustrates an exploded partial perspective view of a condenser in accordance with a fourth embodiment of the present invention.
Figure 12:
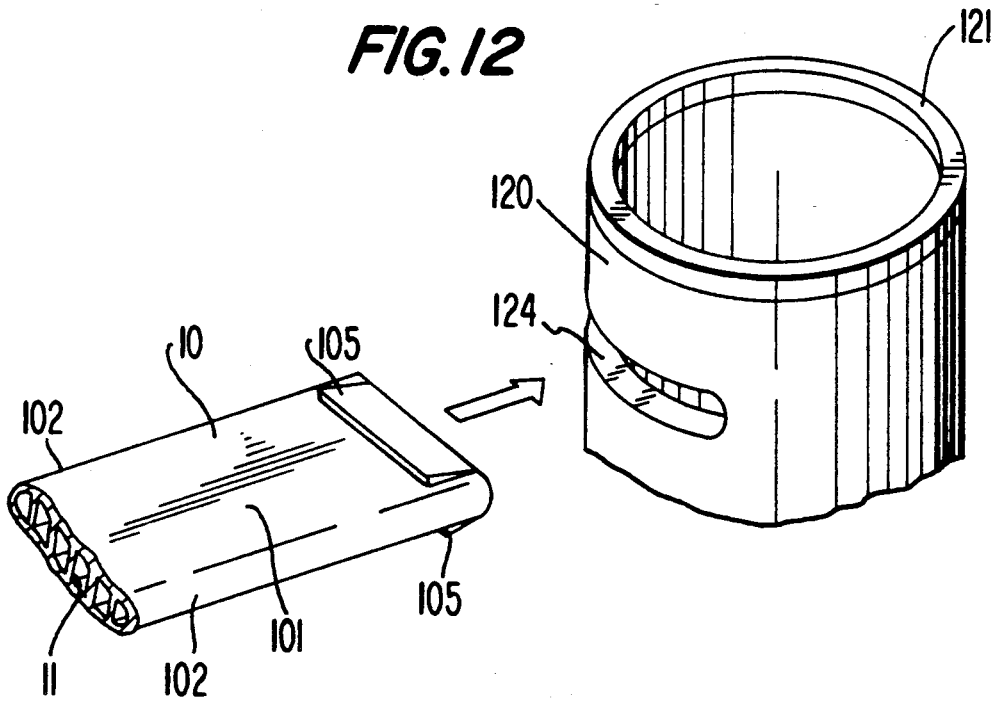
FIG. 12 illustrates an exploded partial perspective view of a condenser in accordance with a third embodiment of the present invention.

A portion of a condenser in accordance with a second embodiment of the present invention is illustrated in FIGS. 9-11. In this embodiment, in addition to a pair of wedge-shaped projections 103, a pair of wedge-shaped projections 104 which are identical to projections 103, are integrally formed on opposite curved surfaces 102. One of wedge-shaped projections 104 is formed on one of the opposite curved surfaces 102 and the other of wedge-shaped projections 104 is formed on the other of opposite curved surfaces 102. Wedge-shaped projections 104 are disposed oppositely of corresponding projections 103, that is, projections 104 slant outwardly towards the adjacent longitudinal end of each flat tube 10. The ridges of projections 104 extend laterally along the opposite curved surfaces 102 from locations adjacent upper and lower surfaces 101. The ridges of projections 104 face the ridges of projections 103. A distance "$W_1$" created between the ridges of projections 103 and the ridges of projections 104 is designed such that each of the opposite side ends of slot 124 is firmly engaged by projection 103' and projection 104 when one longitudinal end of each flat tube 10 is forcibly inserted into the interior of header pipe 120 through each slot 124. In particular, in this embodiment, in addition to the possibility of flat tubes 10 being disengaged from slots 124, the possibility of flat tubes 10 sliding further than desired toward the interior of header pipe 120 through slots 124 is effectively prevented.

FIGS. 12-16 illustrate a portion of a condenser in accordance with a third embodiment of the present invention.

In this embodiment, a pair of identical wedge-shaped projection 105 are integrally formed on opposite flat surfaces 101, adjacent to each longitudinal end of each flat tube 10. One of the wedge-shaped projections 105 is formed on the upper flat surface 101 and the other of wedge-shaped projections 105 is formed on the lower flat surface 101. Wedge-shaped projections 105 slant outward away from the longitudinal end of flat tubes 10 and terminate in ridges which extend laterally across flat surfaces 101. Referring to FIG. 14, a distance "$D_2$" created between the outer edges of the ridges of each wedge-shaped projection 105 in a pair is designed to be slightly greater than a depth "$D_1$" of each slot 124.

When the condenser is temporarily assembled, one longitudinal end of each flat tube 10 is forcibly inserted into an interior of header pipe 120 through each slot 124. The insertion is terminated when the longitudinal end reaches a distance which is approximately one-third of the diameter of an inner periphery of header pipe 120 as illustrated in FIGS. 15 and 16. When the one longitudinal end of each flat tube 10 is forcibly inserted into the interior of header pipe 120 through each slot 124, the pair of wedge-shaped portions 105 are deformed and compressed so as to be able to slidably pass through slot 124. However, after passing through slot 124, wedge-shaped portions 105 are generally restored to become a pair of wedge-shaped portions 105' by virtue of the elasticity of metal. Therefore, a distance "$D_2$" created between the outer edges of the ridges of each wedge-shaped portion 105' in a pair is still greater than depth "$D_1$" of each slot 124. Therefore, the undesirable relative sliding motion between flat tubes 10 and header pipe 120 through slots 124, more particularly, the sliding motion of flat tubes 10 out of slots 124 during the transportation of the temporarily assembled condenser is effectively prevented by wedge-shaped projections 105'. Of course, wedge-shaped projections 105 could also be formed on the opposite longitudinal ends of flat tubes 10.

FIGS. 17-21 illustrate a portion of a condenser in accordance with a fourth embodiment of the present invention. In this embodiment, in addition to wedge-shaped projections 105, a pair of identical wedge-shaped projections 106, identical to projections 105, are integrally formed on upper and lower flat surfaces 101. One of wedge-shaped projections 106 is formed on the upper flat surface 101 and the other of wedge-shaped projections 106 is formed on the lower flat surface 101. Wedge-shaped projections 106 slant outwardly toward the longitudinal end of each flat tube 10, and terminate in ridges which extend laterally across flat surfaces 101. The ridges of projections 106 face the ridges of projections 105.

A distance "$W_2$" created between the ridges of projections 105 and the ridges of projections 106 is designed so that, when flat tubes 10 are inserted into slot 124, the opposite lateral ends of the ridge of projection 105' contact a pair of predetermined locations on an inner arc of slot 124. Simultaneously, the center of the ridge of projections 106 contacts the center of the outer portion of header pipe 120, above and below slot 124. In particular, in this embodiment, in addition to the possibility of flat tubes 10' being disengaged from slots 124, the possibility of flat tubes 10 sliding toward the interior of header pipe 120 through slots 124 is effectively prevented.

Figure 22:
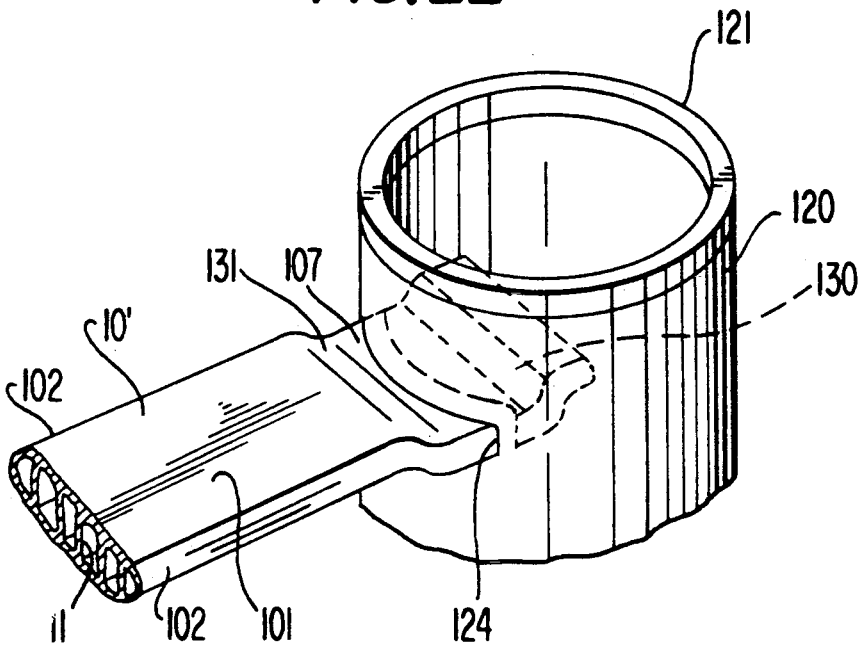
FIG. 22 illustrates an exploded partial perspective view of a condenser in accordance with a fifth embodiment of the present invention.
Figure 23:
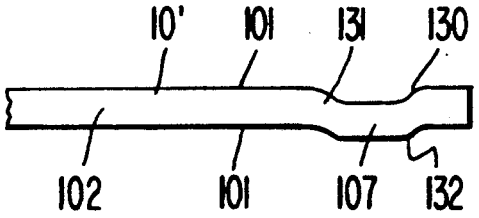
FIG. 23 illustrates a side view of a flat tube shown in FIG. 22.

FIGS. 22 and 23 illustrate a portion of a condenser in accordance with a fifth embodiment of the present invention. In this embodiment, each of flat tubes 10' includes portion 107 having a generally U-shaped longitudinal cross-section formed adjacent to one longitudinal end. Portion 107 includes bottom section 132 and inclined wall portions 130 and 131. Therefore, generally U-shaped portion 107 of each flat tube 10 can prevent flat tubes 10 from sliding relative to header pipe 120 through slots 124 in either longitudinal direction along flat tube 10 due to contact of the lateral ends of wall portion 130 with the inner surface of header pipes 120 and contact of the central portion of wall 131 with the outer surface of header pipes 120.

This invention has been described in detail in connection with the preferred embodiments. However, the description is for illustrative purposes only and the invention is not limited thereto. It will be easily understood by those skilled in the art that variations and modifications can be easily made within the scope of this invention as defined by the appended claims.

I claim:

1. In a heat exchanger comprising a plurality of tubes each having opposite first and second open ends and first and second header pipes, said header pipes including a plurality of openings, the opposite ends of said tubes disposed through said openings, said header pipes fixedly and hermetically coupled to the opposite ends of said tubes, said tubes in fluid communication with the interior of said header pipes through said open ends, the improvement comprising:

at least one of said opposite ends of at least one of said tubes including at least one projection extending outwardly from an exterior surface thereof, said projection engaging an interior surface of at least one of said header pipes adjacent to at least one opening when said one of the opposite ends of said at least one of said tubes is disposed through said at least one opening, said projection formed prior to insertion of said at least one tube into said at least one opening and permitting insertion of said at least one end of said at least one tube without excessive force.

2. The heat exchanger of claim 1, said tubes including a pair of upper and lower substantially flat surfaces linked by a pair of integral curved surfaces.

3. The heat exchanger of claim 2, said at least one projection including a first pair of wedge-shaped projections, one of said first pair of wedge-shaped projections formed on one of said opposite outer curved surfaces and the other of said first pair of wedge-shaped projections formed on the other of said opposite outer curved surfaces.

4. The heat exchanger of claim 3, said wedge-shaped projections slanting outwardly away from said one end of said at least one of said tubes.

5. The heat exchanger of claim 3, said at least one projection including a second pair of wedge-shaped projections, one of said second pair of wedge-shaped projections formed on one of said opposite outer curved surfaces and the other of said second pair of wedge-shaped projections formed on the other of said opposite curved surfaces, each of said first pair of wedge-shaped members disposed oppositely from one of said second pair of wedge-shaped members and separated by a predetermined distance.

6. The heat exchanger of claim 5, each of said first pair of wedge-shaped projections slanting outwardly away from the one end of said at least one of said tubes and each of said second pair of wedge-shaped projections slanting outwardly towards said one end of said at least one of said tubes.

7. The heat exchanger of claim 2, said at least one projection including a first pair of wedge-shaped projections, one of said first pair of wedge-shaped projections formed on said upper flat surface and the other of said first pair of wedge-shaped projections formed on said lower of flat surfaces.

8. The heat exchanger of claim 7, each of said first pair of wedge-shaped projections slanting outwardly away from said one end of said at least one of said tubes.

9. The heat exchanger of claim 8, said projections including a second pair of wedge-shaped projections, one of said second pair of wedge-shaped projections formed on said upper flat surface and the other of said second pair of wedge-shaped projections formed on the lower flat surface, each of said first pair of wedge-shaped members disposed oppositely from one of said second pair of wedge-shaped members and separated by a predetermined distance.

10. The heat exchanger of claim 9, each of said second pair of wedge-shaped projections slant outwardly toward said one end of said at least one of said tubes and each of said first pair of wedge-shaped projections slanting outwardly away from said one end of said at least one of said tubes.

11. The heat exchanger recited in claim 1, each of said flat tubes including at least one projection on at least one end.

12. The heat exchanger recited in claim 11, each of said flat tubes including at least one projection at both ends.

13. The heat exchanger recited in claim 1, said at least one of said tubes including at least one projection at both of said opposite ends.

14. The heat exchanger recited in claim 1, further comprising a plurality of fin units disposed between said plurality of flat tubes, and said header pipes having opposite closed ends.

15. In a heat exchanger comprising a plurality of tubes each having opposite first and second open ends and first and second header pipes, said header pipes including receiving means for receiving the opposite ends of said tubes into an interior thereof, said header pipes fixedly and hermetically coupled to the opposite ends of said tubes, said tubes in fluid communication with the interior of said header pipes through said open ends, the improvement comprising:

a portion of at least one of said tubes having a generally U-shaped longitudinal cross-section formed at at least one of the opposite ends of at least one of said tubes, said portion preventing relative sliding motion between at least one of said header pipes and said at least one of said tubes in at least one direction through said receiving means.

16. The heat exchanger recited in claim 15, said tubes including a pair of upper and lower substantially flat surfaces linked by a pair of integral curved surfaces.

17. The heat exchanger in claim 16, said upper and lower surfaces each having a bottom section and a pair of inclined wall portions which together define said U-shaped longitudinal cross-section.

18. In a heat exchanger comprising a plurality of tubes each having opposite first and second open ends and first and second header pipes, said header pipes including a plurality of openings, the opposite ends of said tubes disposed through said openings, said header pipes fixedly and hermetically coupled to the opposite ends of said tubes, said tubes in fluid communication with the interior of said header pipes through said open ends, said tubes including a pair of upper and lower substantially flat surfaces linked by a pair of integral curved surfaces, the improvement comprising:

at least one of said opposite ends of at least one of said tubes including a first pair of wedge-shaped projections extending outwardly from an exterior surface thereof, one of said first pair of wedge-shaped projections formed on one of said opposite outer curved surfaces and the other of said first pair of wedge-shaped projections formed on the other of said opposite outer curved surfaces, said first pair of wedge-shaped projections engaging an interior surface of at least one of said header pipes adjacent to at least one opening when said one of the opposite ends of said at least one of said tubes is disposed through said at least one opening.

19. The heat exchanger of claim 18, said wedge-shaped projections slanting outwardly away from said one end of said at least one of said tubes.

20. The heat exchanger of claim 18, including a second pair of wedge-shaped projections, one of said second pair of wedge-shaped projections formed on one of said opposite outer curved surfaces and the other of said second pair of wedge-shaped projections formed on the other of said opposite curved surfaces, each of said first pair of wedge-shaped members disposed oppositely from one of said second pair of wedge-shaped members and separated by a predetermined distance.

21. The heat exchanger of claim 20, each of said first pair of wedge-shaped projections slanting outwardly away from the one end of said at least one of said tubes and each of said second pair of wedge-shaped projections slanting outwardly towards said one end of said at least one of said tubes.

22. In a heat exchanger comprising a plurality of tubes each having opposite first and second open ends and first and second header pipes, said header pipes including a plurality of openings, the opposite ends of said tubes disposed through said openings, said header pipes fixedly and hermetically coupled to the opposite ends of said tubes, said tubes in fluid communication with the interior of said header pipes through said open ends, said tubes including a pair of upper and lower substantially flat surfaces linked by a pair of integral curved surfaces, the improvement comprising:

at least one of said opposite ends of at least one of said tubes including a first pair of wedge-shaped projections extending outwardly from an exterior surface thereof, one of said first pair of wedge-shaped projections formed on said upper flat surface and the other of said first pair of wedge-shaped projections formed on said lower flat surfaces, said first pair of wedge-shaped projections engaging an interior surface of at least one of said header pipes adjacent to at least one opening when said one of the opposite ends of said at least one of said tubes is disposed through said at least one opening.

23. The heat exchanger of claim 22, each of said first pair of wedge-shaped projections slanting outwardly away from said one end of said at least one of said tubes.

24. The heat exchanger of claim 22, including a second pair of wedge-shaped projections, one of said second pair of wedge-shaped projections formed on said upper flat surface and the other of said second pair of wedge-shaped projections formed on the lower flat surface, each of said first pair of wedge-shaped members disposed oppositely from one of said second pair of wedge-shaped members and separated by a predetermined distance.

25. The heat exchanger of claim 24, each of said second pair of wedge-shaped projections slant outwardly toward said one end of said at least one of said tubes and each of said first pair of wedge-shaped projections slanting outwardly away from said one end of said at least one of said tubes.

* * * * *